United States Patent [19]

Dubuit et al.

[11] Patent Number: 5,046,412

[45] Date of Patent: Sep. 10, 1991

[54] FIXED PRINTING AXIS PRINTING MACHINE WITH MULTIRATIO TRANSMISSION MEANS VARYING THE LOCATION OF THE OBJECT TO BE PRINTED

[75] Inventors: Jean-Louis Dubuit, Paris; Eric Rouly, Pontaut Combault; Jean-Pierre Douville, Gagny, all of France

[73] Assignee: Societe D'Exploitation Des Machines Dubuit, Noisy Le Grand, France

[21] Appl. No.: 436,719

[22] Filed: Nov. 15, 1989

[30] Foreign Application Priority Data

Dec. 5, 1988 [FR] France ..... 88 15898

[51] Int. Cl.[5] ..... B41F 17/22

[52] U.S. Cl. ..... 101/39; 101/124

[58] Field of Search ..... 101/38.1, 39, 40, 40.1, 101/124, 126

[56] References Cited

U.S. PATENT DOCUMENTS

| | | | |
|---|---|---|---|
| 3,277,816 | 10/1966 | Olsen | 101/38 |
| 3,762,318 | 10/1973 | Dubuit | 101/38.1 X |
| 4,434,714 | 3/1984 | Combeau | 101/38 |
| 4,498,386 | 2/1985 | Rouly et al. | 101/40 |
| 4,782,750 | 11/1988 | Marette | 101/39 |

FOREIGN PATENT DOCUMENTS

| | | |
|---|---|---|
| 0059674 | 9/1982 | European Pat. Off. . |
| 0063390 | 10/1982 | European Pat. Off. . |

*Primary Examiner*—Clifford D. Crowder

*Attorney, Agent, or Firm*—Charles A. Brown

[57] ABSTRACT

A printing machine suitable for printing objects with an oblong or a circular transverse cross-section includes a fixed printing shaft. An object to be printed is rotated about the printing shaft in contact with a flat printing plate or the like carried by a mobile assembly. The distance between the printing shaft and the printing plate or the like is corrected automatically. A drive shaft rotates the object to be printed through a transmission system which provides at least two transmission ratios.

16 Claims, 1 Drawing Sheet

FIG. 1
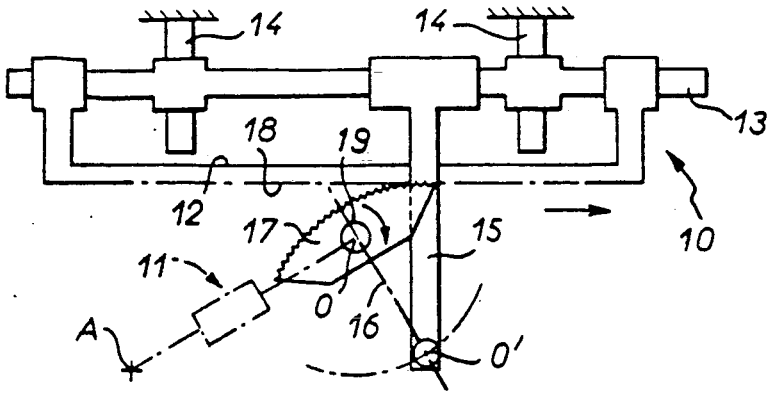
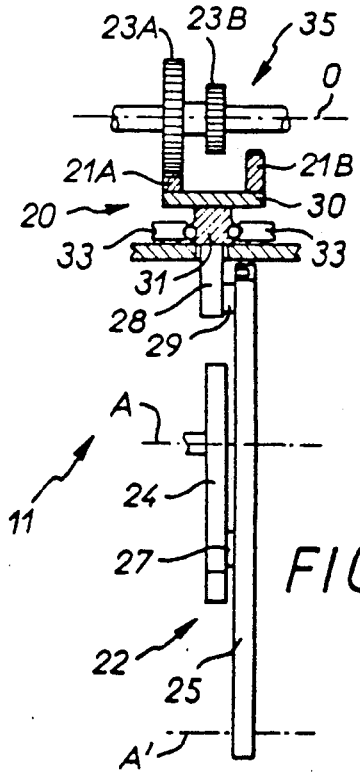
FIG. 3
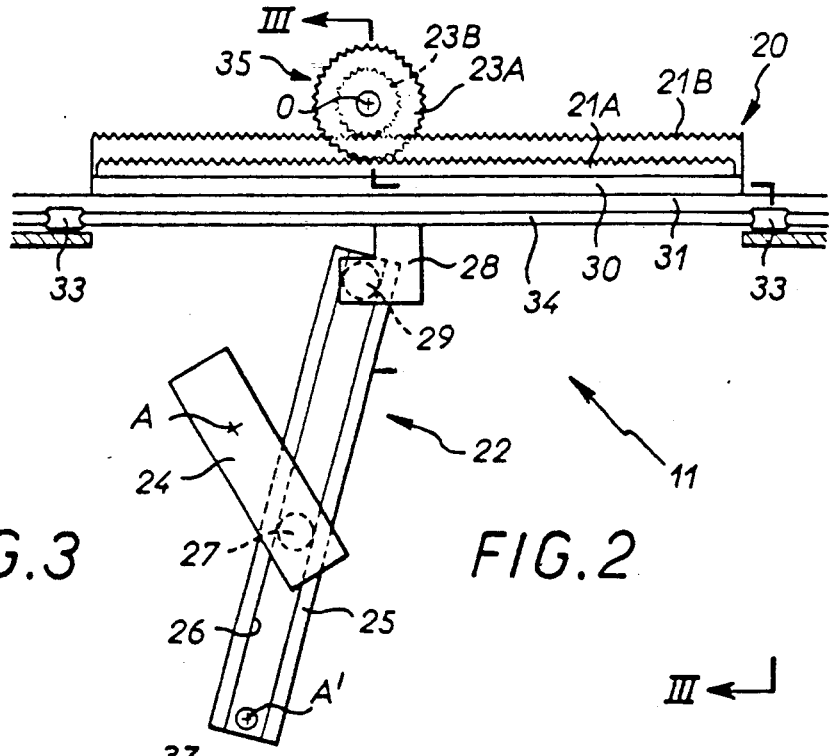
FIG. 2
FIG. 4
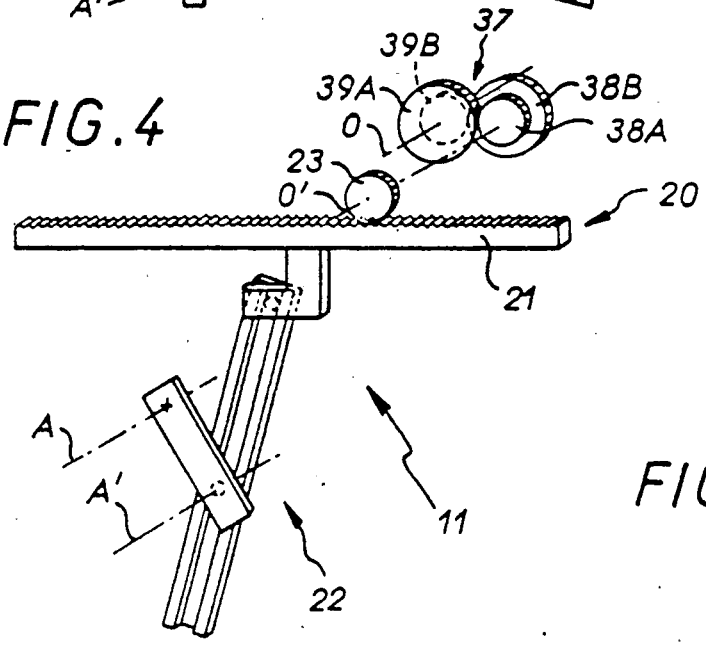
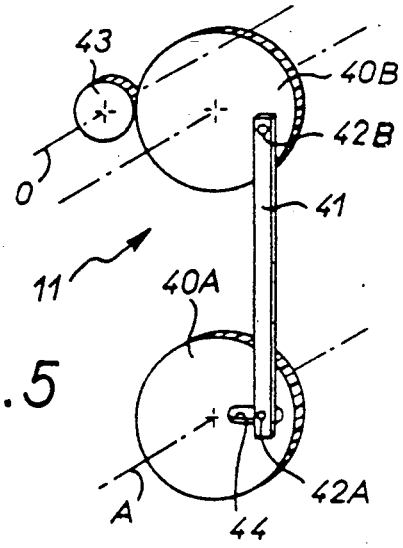
FIG. 5

FIXED PRINTING AXIS PRINTING MACHINE WITH MULTIRATIO TRANSMISSION MEANS VARYING THE LOCATION OF THE OBJECT TO BE PRINTED

BACKGROUND OF THE INVENTION

1. Field of the invention

The present invention is generally concerned with fixed printing shaft printing machines of the kind described in published European patent application No. 0260178 filed under application number 87401897.1 on Aug. 18, 1987 corresponding to U.S. Pat. No. 4,782,750 hereby incorporated by reference.

2. DESCRIPTION OF THE PRIOR ART

A machine of this kind prints on a substantially cylindrical convex area of an object. It comprises a fixed printing axis, a mobile assembly adapted to carry a flat printing plate or the like, rotation means for rotating an object to be printed about the printing axis in contact with the printing plate or the like, correction means for correcting the distance between the printing axis and the printing plate or the like, a drive shaft and transmission means coupling the rotation means to the drive shaft.

Specifically designed for printing objects with an oblong (usually called "oval") transverse cross-section, a printing machine of this kind can also be used to print objects with a circular transverse cross-section.

However, although pivoting through an angle of 130° is generally sufficient for printing an object with an oblong transverse cross-section, to print an object with a circular transverse cross-section the object has to rotate on itself by significantly more than one revolution.

A general object of the present invention is an arrangement providing a particularly simple way to satisfy this two-fold requirement.

SUMMARY OF THE INVENTION

The invention consists in a printing machine comprising a fixed printing shaft, a mobile assembly adapted to carry a flat printing plate or the like, rotation means for rotating an object to be printed about the printing shaft in contact with the printing plate or the like, correction means for correcting the distance between the printing shaft and the printing plate or the like, a drive shaft, and transmission means coupling the rotation means to the drive shaft and adapted to provide at least two transmission ratios.

One transmission ratio is chosen for printing objects with an oblong transverse cross-section and the other is chosen for printing objects with a circular transverse cross-section.

The characteristics and advantages of the invention will emerge from the following description given by way of example with reference to the appended diagrammatic drawings.

BRIEF DESCRIPTION OF THE DRAWINGS

FIG. 1 is a schematic view in elevation of a printing machine in accordance with the invention.

FIG. 2 is a schematic view in elevation showing the transmission means coupling the printing shaft of the printing machine to its drive shaft.

FIG. 3 is a view of the transmission means in transverse cross-section on the broken line III—III in FIG. 2.

FIG. 4 is a schematic perspective view of a first embodiment of the transmission means.

FIG. 5 is a schematic perspective view of a second embodiment of the transmission means.

DESCRIPTION OF THE PREFERRED EMBODIMENTS

FIG. 1 shows a printing machine of the kind shown in FIG. 7 of the previously mentioned European patent application No. 0260178.

The printing machine comprises a mobile assembly 10 adapted to carry a flat printing plate or the like (hereinafter called the printing means), for example a silk screen, rotation means 19 for rotating the object to be printed (not shown) about a fixed printing axis O in contact with the printing plate, correction means adapted to correct the distance between the printing means and the fixed printing axis O, and transmission means 11 coupling the rotation means 19 to a drive shaft A.

In more detail, the mobile assembly 10 includes a printing means support 12 which is mobile parallel to its plane on a guide 13 which is itself mobile perpendicularly to the plane on guides 14.

In practise, the guide 13, which is optionally duplicated, is horizontal and the guides 14, which can also optionally be duplicated, are vertical.

The correction means for correcting the distance between the printing means and the fixed printing axis O when the object to be printed has an oblong transverse cross-section include an upright 15 to which the printing plate support 12 is fastened and which, like the support 12, is mobile on the guide 13 parallel to the plane of the printing means. It is articulated to a crank 16 constrained to rotate with the rotation means, 19 as will be explained in more detail later, and adapted to rotate the object to be printed about the fixed printing axis O.

These arrangements are known in themselves from European patent application No 0260178 and will not be described in more detail here.

Suffice to say that a sector pinion 17 is constrained to rotate with a fixed printing shaft. Carried by the crank 16, it is centered on the axis O' about which the latter is pivoted to the upright 15. It meshes with a rack 18 fastened to the printing means support 12.

According to the invention, the transmision means 11 coupling the drive shaft A and a fixed printing shaft having an axis coinciding with the fixed printing axis O provide at least two transmission ratios.

In the embodiment shown in FIGS. 2 and 3 the transmission means 11 include a carriage 20 carrying at least two parallel racks 21A, 21B of different heights, reciprocating means 22, to be described in more detail later, coupling the carriage 20 to the drive shaft A, and at least two pinions 23A, 23B of different diameter coaxial with the printing axis O and selectively meshing with the respective racks 21A, 21B.

The drive shaft A is the output shaft of a continuously rotating motor, for example.

The reciprocating means 22 include a crank 24 constrained to rotate with the drive shaft A, a link 25 pivoting about a fixed pivot A' parallel to the drive shaft A and engaging by way of a groove 26 with a follower or roller 27 rotatably mounted on the crank 24, eccentric to its drive shaft A, and a depending member 28 fastened to the carriage 20 and carrying a roller 29 through which it meshes with the groove 25 in the link 22.

The carriage 20 has a baseplate 30 which carries the two parallel racks 21A, 21B and a longitudinal member 31 which carries the plate 30 on its upper surface and the depending member 28 on its lower surface.

The longitudinal member 31 of the carriage 20 lies between rollers 33 which guide and support it and therefore the carriage 20. They are mounted to rotate on the frame of the system and cooperate with bars 34 provided for this purpose on opposite sides of the longitudinal member 31.

Finally, the pinions 23A, 23B form a mobile system 35 movable along the printing axis O and constrained to rotate with the printing shaft.

The distance between the pinions 23A, 23B is different to the distance between the racks 21A, 21B (less than it in this example).

When, as shown in the figures, the larger diameter pinion 23A meshes with the smaller height rack 21A the amplitude of displacement of the carriage 20 is at its maximum.

This is suitable for printing a circular cross-section object.

To print an oblong cross-section object it is sufficient to displace the mobile system 35 along the printing axis O until the smaller diameter pinion 23B meshes with the greater height rack 21B.

The amplitude of displacement of the carriage 20 is then at its minimum.

In the embodiment shown in FIG. 4 the transmission means 11 include, as previously, a carriage 20 the structure of which is of the same kind as described with reference to FIGS. 2 and 3, except that it carries only one rack 21.

The transmission means also include reciprocating means 22, also of the same kind as described with reference to FIGS. 2 and 3. As previously, it couples the drive shaft A and the carriage 20.

The transmission means further include a pinion 23 which meshes with the rack 21 and a gearbox 37 with at least two gear ratios coupling the shaft O' of the pinion 23 and the printing shaft.

The gearbox comprises two pinions 38A, 38B of different diameter constrained to rotate with the shaft O' of the pinion 23 and two pinions 39A, 39B, also of different diameter, constrained to rotate with the printing shaft. As previously, these form a mobile system movable along the printing axis O and are selectively adapted to mesh respectively with the pinion 38A and the pinion 38B.

In the embodiment shown in FIG. 5 the transmission means 11 include two cranks 40A, 40B each in the form of a rotating disk. They are respectively constrained to rotate with the drive shaft A and the printing shaft. A link 41 is articulated to both cranks 40A, 40B and at least one of the corresponding articulations 42A, 42B is adjustable in position relative to the crank 40A, 40B concerned.

The crank 40A is constrained to rotate with the drive shaft A directly and the crank 40B is contrained to rotate with the printing shaft through the intermediary of a pinion 43.

In this embodiment it is the articulation 42A of the link 41 which is adjustable in position on the crank 40A, the pivot pin 42A passing through a substantially radial slot 44 in the crank 40A and being adapted to be locked in position in the slot 44.

It suffices to adjust the position of the pivot pin 42A in the slot 44 to obtain the required transmission ratio.

Of course, the present invention is not limited to the embodiments described and shown but encompasses any variant execution thereof.

We claim:

1. A printing machine for printing on an object, comprising a mobile assembly having a support for flat printing means, rotation means for rotating an object to be printed about a fixed printing axis in contact with the printing means, correction means for varying the distance between the printing axis and the printing means, a drive shaft, transmission means coupling said rotation means to said drive shaft and having at least two transmission ratios for selectively rotating an object about the printing axis through corresponding different angular displacements for a given angular displacement of said drive shaft, said transmission means comprising a carriage, at least two parallel racks mounted on said carriage, reciprocating means coupling said carriage to said drive shaft, and at least two pinions of different diameters coaxial with a respective one of said racks for defining one of said transmission ratios.

2. A printing machine according to claim 1, wherein said pinions are carried by a printing shaft having an axis coinciding with said printing axis, said pinions and printing shaft defining a movable assembly mounted for movement along the printing axis to bring said pinions into meshing relation with respective ones of the racks, said movable assembly being rotatable about said printing axis.

3. A printing machine according to claim 1, comprising a roller on each side of said carriage for guiding and supporting said carriage.

4. A printing machine according to claim 1 for selectively printing objects having oblong cross sections and circular cross sections, and said angular displacement of an object corresponding to a first one of the transmission ratios is less than 180 degrees and the angular displacement of an object corresponding to a second one of the transmission ratios is more than 360 degrees.

5. A printing machine for printing on an object, comprising a mobile assembly having a support for flat printing means, rotation means for rotating an object to be printed about a fixed printing axis in contact with the printing means, correction means for varying the distance between the printing axis and the printing means, a drive shaft, transmission means coupling said rotation means to said drive shaft and having at least two transmission ratios for selectively rotating an object about the printing axis through corresponding different angular displacements for a given angular displacement of said drive shaft, said transmission means comprising a carriage, a rack mounted on said carriage, reciprocating means coupling said carriage to said drive shaft, a pinion meshing with said rack, gear box means coupled between said pinion and said rotation means for defining said at least two transmission ratios.

6. A printing machine according to claim 5, comprising a roller disposed on each side of said carriage for guiding and supporting said carriage.

7. A printing machine according to claim 5 for selectively printing objects having oblong cross sections and circular cross sections, and said angular displacement of an object corresponding to a first one of the transmission ratios is less than 180 degrees and the angular displacement of an object corresponding to a second one of the transmission ratios is more than 360 degrees.

8. A printing machine for printing on an object, comprising a mobile assembly having a support for flat printing means, rotation means for rotating an object to be printed about a fixed printing axis in contact with the printing means, correction means for varying the distance between the printing axis and the printing means, a drive shaft, transmission means coupling said rotation means to said drive shaft and having at least two transmission ratios for selectively rotating an object about the printing axis through corresponding different angular displacements for a given angular displacement of said drive shaft, said transmission means comprising two cranks, one of said cranks being constrained to the drive shaft and the other of said cranks being constrained for rotation with said rotation means, an articulation being provided between each crank and said link, means for adjusting the position of at least one of said articulations on a corresponding one of said cranks.

9. A printing machine for printing on an object comprising mobile assembly having a support for flat printing means, means mounting said mobile assembly for movement parallel to the printing means, means mounting said mobile assembly for movement perpendicular to said printing means, rotation means for rotating an object to be printed about a fixed printing axis in contact with the printing means, correction means for varying the distance between the printing axis and the printing means, said correction means including a member mounted for movement parallel to the printing means, a rack mounted on said mobile assembly, a sector gear in meshing engagement with the rack, a crank connected to the sector gear and pivoted on said member, a drive shaft, transmission means coupling said rotation means to said drive shaft and having at least two transmission ratios for selectively rotating the object about the printing axis through corresponding different angular displacements for a given angular displacement of said drive shaft, said transmission means comprising a carriage, at least two parallel racks mounted on said carriage, reciprocating means coupling said carriage to said drive shaft, and at least two pinions of different diameters coaxial with said printing axis, each of said pinions selectively meshing with a respective one of said racks.

10. A printing machine according to claim 9, wherein said pinions care carried by a printing shaft having an axis coinciding with said printing axis, said pinions and printing shaft defining an assembly mounted for movement on the printing axis and rotatable about said printing axis.

11. A printing machine according to claim 9, comprising a roller on each side of said carriage for guiding and supporting said carriage.

12. A printing machine according to claim 9 for selectively printing objects having oblong cross sections and circular cross sections, and said angular displacement of an object corresponding to a first one of the transmission ratios is less than 180 degrees and the angular displacement of an object corresponding to a second one of the transmission ratios is more than 360 degrees.

13. A printing for printing on an object comprising mobile assembly having a support for flat printing means, means mounting said mobile assembly for movement parallel to the printing means, means mounting said mobile assembly for movement perpendicular to said printing means, rotation means for rotating an object to be printed about a fixed printing axis in contact with the print means, correction means for varying the distance between the printing axis and the printing means, said correction means including a member mounted for movement parallel to the printing means, a rack mounted on said mobile assembly, a sector gear in meshing engagement with the rack, a crank connected to the sector gear and pivoted on said member, a drive shaft, transmission means coupling said rotation means to said drive shaft and having at least two transmission ratios for selectively rotating the object about the printing axis through corresponding different angular displacements for a given angular displacement of said drive shaft, said transmission means comprising a carriage, a rack mounted on said carriage, reciprocating means coupling said carriage to said drive shaft, a pinion meshing with said rack, gear box means coupled between said pinion and said rotation means for defining said at least two transmission ratios.

14. A printing machine according to claim 13, comprising a roller disposed on each side of said carriage for guiding and supporting said carriage.

15. A printing machine according to claim 13 for selectively printing objects having oblong cross sections and circular cross sections, and said angular displacement of an object corresponding to a first one of the transmission ratios is less than 180 degrees and the angular displacement of an object corresponding to a second one of the transmission ratios is more than 360 degrees.

16. A printing machine for printing on an object comprising mobile assembly having a support for flat printing means, means mounting said mobile assembly for movement parallel to the printing means, means mounting said mobile assembly for movement perpendicular to the printing means, rotation means for rotating an object to be printed about a fixed printing axis in contact with the printing means, correction means for varying the distance between the printing axis and the printing means, said correction means including a member mounted for movement parallel to the printing means, a rack mounted on said mobile assembly, a sector gear in meshing engagement with the rack, a crank connected to the sector gear and pivoted on said member a drive shaft, transmission means coupling said rotation means to said drive shaft and having at least two transmission ratios for selectively rotating the object about the printing axis through corresponding different angular displacements for a given angular displacement of said drive shaft, said transmission means comprising two cranks, one of said cranks being constrained to said drive shaft and the other of said cranks being constrained for rotation with the rotation means, and an articulation being provided between each crank and said link, means for adjusting the position of at least one of said articulations on a corresponding one of said cranks.

* * * * *